US005105920A

United States Patent [19]

Grebenstein

[11] Patent Number: 5,105,920

[45] Date of Patent: Apr. 21, 1992

[54] ZIPPED SUITCASE WITH WHEELS SUPPORTED BY PERIPHERAL FRAME SECTIONS

[76] Inventor: Hans-Juergen Grebenstein, Ludwigsburger Strasse 61, 7100 Heilbronn, Fed. Rep. of Germany

[21] Appl. No.: 543,960

[22] Filed: Jun. 27, 1990

[30] Foreign Application Priority Data

Jun. 30, 1989 [DE] Fed. Rep. of Germany ..... 3921552

[51] Int. Cl.[5] ..... A45C 5/14; A45C 7/00; A45C 13/04; A45C 13/10

[52] U.S. Cl. ..... 190/18 A; 190/103; 190/111; 190/119; 190/122; 190/127; 190/903

[58] Field of Search ..... 150/101, 114; D3/71, D3/76; 206/287.1, 293; 190/103, 107, 109, 111, 112, 122, 127, 125, 108, 18 A, 901, 119, 126, 115

[56] References Cited

U.S. PATENT DOCUMENTS

| | | | |
|---|---|---|---|
| D. 109,553 | 5/1938 | Doppelt | 190/119 X |
| D. 280,866 | 10/1985 | Bomes et al. | D3/71 X |
| 1,463,729 | 7/1923 | Stember | 150/101 |
| 1,712,448 | 5/1929 | Eckhardt | 190/103 |
| 2,104,935 | 1/1938 | Solomon | 190/109 |
| 2,670,776 | 3/1954 | Benner | 190/103 X |
| 2,907,420 | 10/1959 | Doppelt | 190/109 X |
| 2,964,149 | 12/1960 | Smallberg | 190/111 |
| 3,291,267 | 12/1966 | Pelavin | 190/111 |
| 3,447,649 | 6/1969 | Kish, Jr. | 190/111 |
| 4,420,068 | 12/1983 | Gerch | 190/111 X |
| 4,437,549 | 3/1984 | Gibbs | 190/126 X |
| 4,753,342 | 6/1988 | Pulichino, Jr. et al. | 190/109 X |
| 4,762,211 | 8/1988 | Krenzel | 190/122 |
| 4,781,278 | 11/1988 | Sadow | 190/127 X |
| 4,817,791 | 4/1989 | Adams | 206/287.1 |
| 4,825,985 | 5/1989 | Kim | 190/112 X |
| 4,925,021 | 5/1990 | Pulichino, Jr. | 190/112 X |
| 4,927,014 | 5/1990 | Pulichino, Jr. | 206/293 X |
| 4,932,506 | 6/1990 | Kim | 190/111 |
| 4,966,259 | 10/1990 | Bergman | 190/115 X |

FOREIGN PATENT DOCUMENTS

| | | | |
|---|---|---|---|
| 2038863 | 2/1972 | Fed. Rep. of Germany | 190/122 |
| 683902 | 3/1965 | Italy | 190/18 A |
| 588568 | 5/1947 | United Kingdom | 190/103 |
| 1208113 | 10/1970 | United Kingdom | 190/103 |
| 2201335 | 9/1988 | United Kingdom | 190/115 |

*Primary Examiner*—Sue A. Weaver
*Attorney, Agent, or Firm*—Foley & Lardner

[57] ABSTRACT

A zipped suitcase having a top side, two narrow side walls, a bottom part and two large side walls which can be folded back from a frame-reinforced body via zippers extending over the two narrow side walls wherein the frame-reinforced body includes a broad first section reinforced by two spaced-apart peripheral frames, which broad first section has a partition between the two peripheral frames, and of a narrow second section connected to the broad first section via a zipper and likewise reinforced by a third peripheral frame.

14 Claims, 6 Drawing Sheets

ZIPPED SUITCASE WITH WHEELS SUPPORTED BY PERIPHERAL FRAME SECTIONS

BACKGROUND OF THE INVENTION

The present invention relates to a zipped suitcase having a top side, two narrow side walls, a bottom part and two large side walls which can be folded back from a frame-reinforced body via zippers extending over the length of the two narrow side walls and the top side.

Zipped suitcases of this type have been known for a long time. They generally comprise a central part which is reinforced by a frame, in which the frame can be more or less stable and which, in less-expensive models, is formed by cardboard inserts. The frame affording the stability of the suitcase typically is covered with a fabric material, the two large side walls being connected by zippers to the fabric material of the central part so that the suitcase can be opened by undoing a zipper. If there are zippers on both sides of the central part, it is possible to open the suitcase from both sides. The use of zippers with this type of suitcase has the advantage that no hinges are required for folding back the suitcase. A disadvantage associated with conventional zipped suitcases is their generally low stability and their low degree of organization which is not appropriate for more sophisticated use of the suitcase.

SUMMARY OF THE INVENTION

It is therefore an object of the present invention to provide a zipped suitcase having improved stability, reinforcement, handling and degree of organization.

In accomplishing the foregoing object there is provided according to the present invention, a zipped suitcase having a top side, two narrow side walls, a bottom part and first and second large side walls which can be folded back from a frame-reinforced body via first and second zippers extending over the length of the two narrow side walls and the top side, wherein the frame-reinforced body comprises a broad first section reinforced by first and second spaced-apart peripheral frames, which broad first section has a partition between the two frames, and a narrow second section connected to the broad first section via a third zipper, which narrow second section is reinforced by a third peripheral frame.

Further objects, features and advantages of the present invention will become apparent from the detailed description of preferred embodiments that follows.

BRIEF DESCRIPTION OF THE DRAWINGS

The invention is to be described in greater detail below with reference to an exemplary embodiment illustrated in the drawing, in which.

DETAILED DESCRIPTION OF THE PREFERRED EMBODIMENTS

Figure 1:
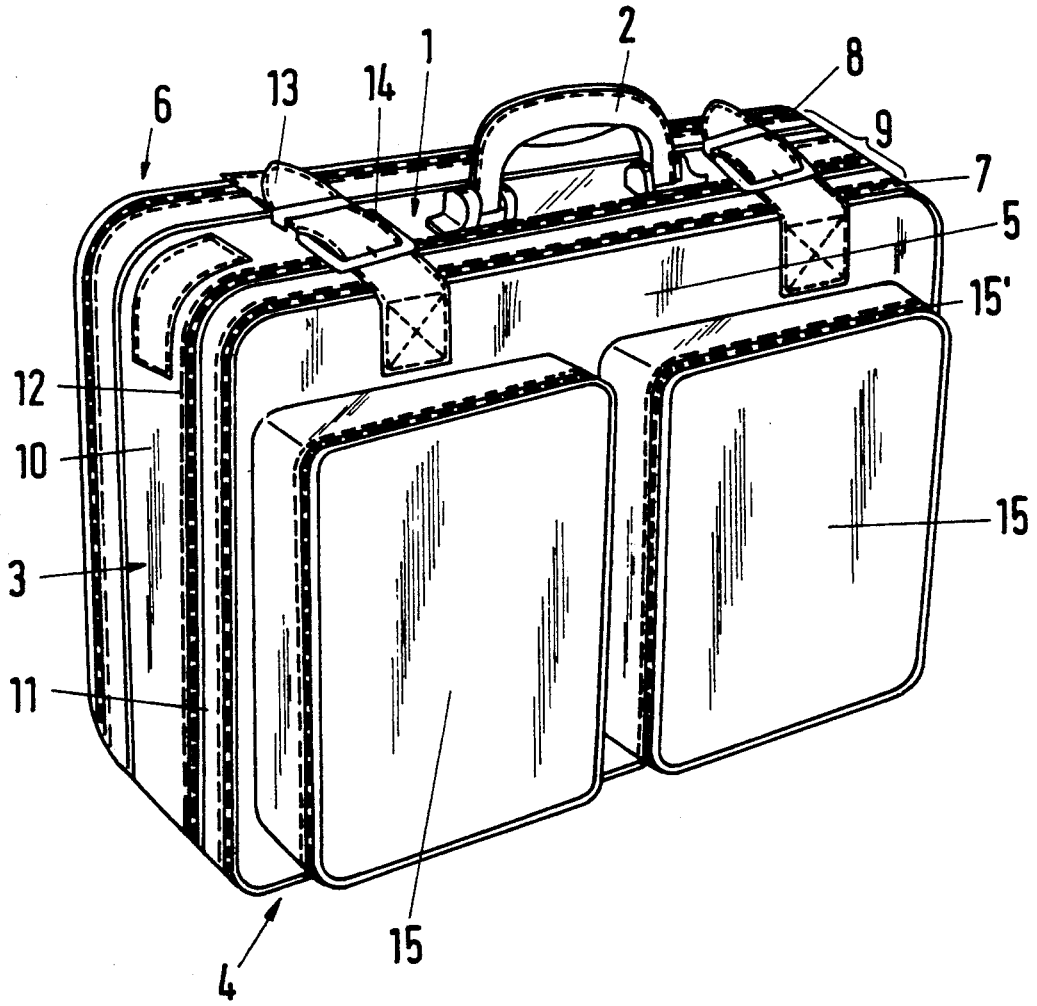
FIG. 1 is a perspective view of a closed zipped suitcase according to the present invention.

The zipped suitcase according to the present invention has three frames, of which two reinforce the broad first section and one is mounted in the narrow second section which can be folded back from the broad first section after the third zipper has been undone. The two large side walls can each be folded back from the frame-reinforced body after the first and second zippers, respectively, have been undone.

The zipped suitcase according to the present invention is constructed in such a way that it can be packed and unpacked in a standing state. In this case, the broad first section always remains standing upright, the narrow second section either likewise standing upright and being connected to the broad first section by the third zipper or being folded back after the third zipper connecting the first and second sections has been undone.

The narrow second section preferably is accessible after the large side wall attached to it has been opened. Preferably, there is a first partition dividing the narrow second section and the broad first section. In contrast, the broad first section can be packed from both sides since a second partition divides the broad first section into two separate packing spaces. A holder for coathangers is mounted on one side of the partition, preferably in the top side of the peripheral frame. On the other side of the partition, there can be arranged a conventional packing surface with packing straps or preferably an arrangement of a plurality of pockets filling the corresponding space, which pockets can be fastenable to the respective peripheral frame.

The zipped suitcase according to the present invention is suitable as a full-scale travel suitcase and preferably includes four wheels being arranged adjacent to one another over the width of the bottom of the suitcase. Of these wheels, two are attached adjacent to each other on the central one of the three frames and the other two wheels are attached one on each of the other two frames. Four wheels of this type are preferably arranged at each end of the suitcase, seen in the longitudinal direction, so that the suitcase can be wheeled on a total of eight wheels after its handle has been gripped.

The organization of the zipped suitcase according to the present invention can be improved further in that the large side wall, which can be folded back from the narrow second section, is fitted with at least one, preferably two, outside pockets which are fitted with an openable wall or flap toward the side wall. Due to this construction, the outside pocket, for example, can be folded back from the large side wall, but it can also remain on the large side wall and be accessible by the openable wall or flap after the side wall has been folded back. It is very advantageous for the outside pocket to have an arrangement of several closable small pockets, said arrangement being accessible after the wall has been opened, thereby providing a high degree of organization for toiletries or office accessories.

The large side wall which can be folded back from the broad first section preferably lies opposite the packing space of the broad first section fitted with the holder for coat-hangers and is fitted with a packing panel which can be folded away from the interior of the suitcase. The jackets and pants hung on the coat-hanger can be folded down by about a 90° angle onto the large side wall, which has been folded back and is lying on the surface, and then they can be fastened there by returning the packing panel to its folded-down position so that the folding up and fastening of the side wall to the broad first section by means of the zipper is possible without the risk of the carefully placed jackets and pants slipping. For this purpose, the free end of the packing panel can be held on the large side wall by touch and close fasteners or the like in order to prevent it from folding out. Here, the side wall itself can be further fitted with a zipped pocket extending over its entire width.

Figure 4:
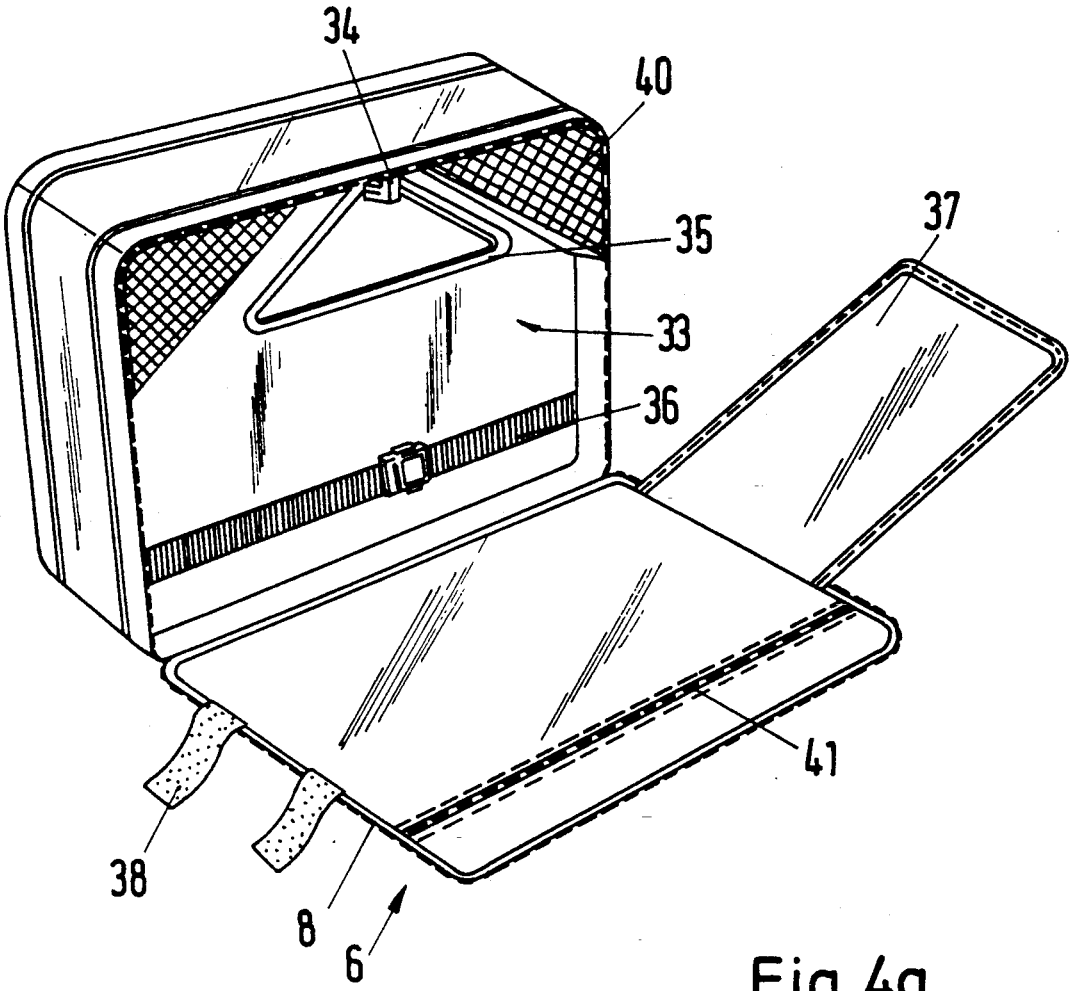
FIG. 4 is a perspective view of a zipped suitcase according to FIG. 1 opened on the other side from the side shown in FIG. 2 by folding back the large side wall and with the packing panel folded back.

The peripheral frames used in the zipped suitcase can be formed in a conventional manner, but they are preferably injection molded plastic parts as depicted, for example, in FIG. 4. Preferably, the peripheral frames have an outer covering of a flexible material such as fabric or leather.

The zipped suitcase illustrated has a top side 1 with a suitcase handle 2, two narrow side walls 3 and a bottom 4. The suitcase is closed by a front large side wall 5 and a rear large side wall 6. The two large side walls 5, 6 are attached by zippers 7, 8 to a body 9 forming the walls 1, 3, 4. The body 9 consists of a broad first section 10 and a more narrow second section 11 which are interconnected in the closed state by a zipper 12. The zippers 7, 8, 12 extend over the length of the two narrow side walls 3 and the top side 1 so that, by opening the zippers, the components of the suitcase are only joined via a connection on the bottom 4 of the suitcase. This connection functions as a fabric hinge.

In the closed state of the suitcase, as is illustrated in FIG. 1, the holding force of the zippers 7, 8, 12 is supported by customary suitcase straps 13 which provide relief for the zippers 7, 8, 12 under strong loading in the direction of opening and can be closed in a conventional manner on the top side 1 with a buckle 14.

The front large side wall 5 is fitted with two outside pockets 15 each of which can be opened by means of a zipper 15'.

Figures 2, 2A:
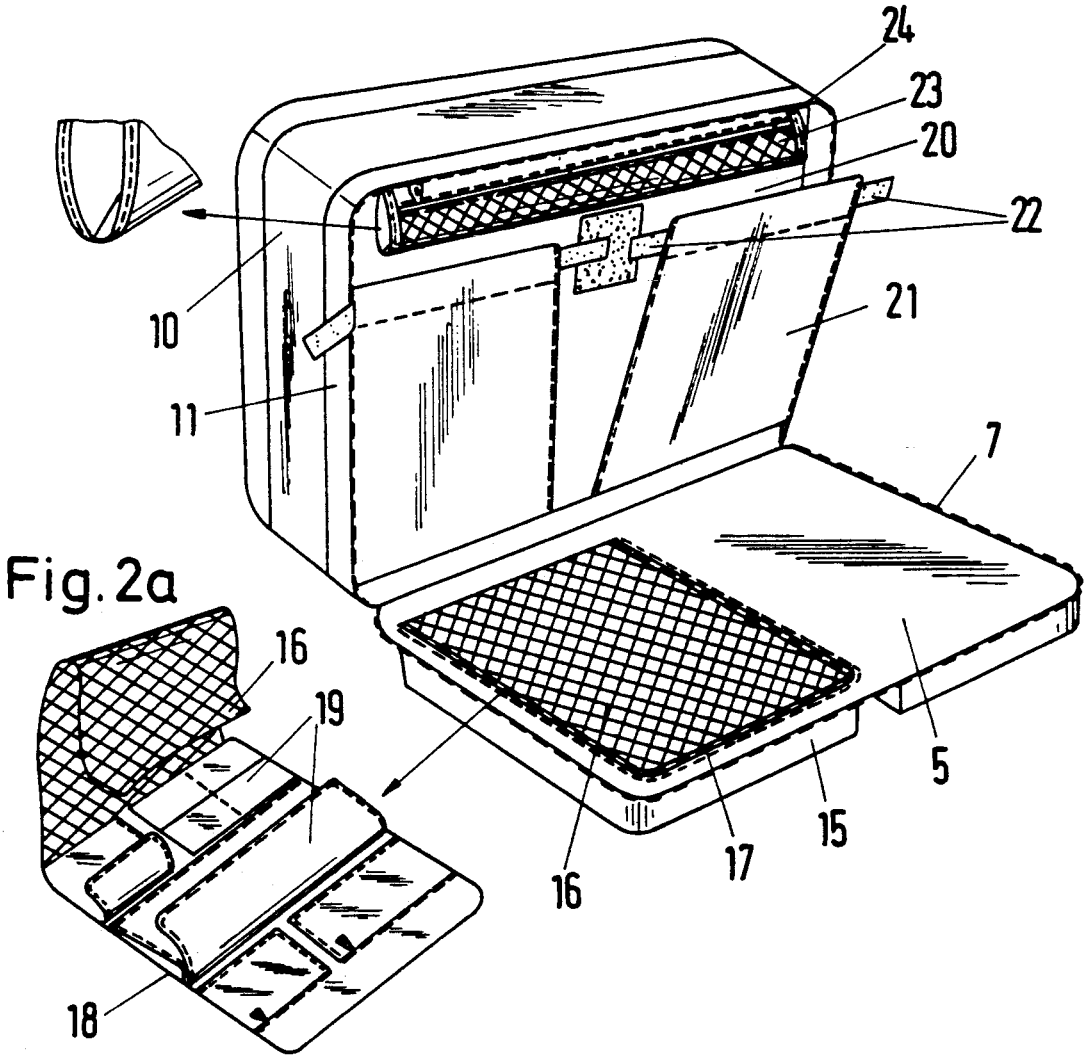
FIG. 2 is a perspective view of a zipped suitcase according to FIG. 1 opened by folding back the large side wall fitted with outside pockets.
FIG. 2*a* is an exploded view of an example of the interior fittings of an outside pocket.

FIG. 2 shows the state of the suitcase according to FIG. 1 after the zipper 7 has been undone, that is to say after the front large side wall 5 has been folded back. Preferably at least one of the pockets 15 has a transparent rear wall or flap 16, which is formed preferably by a latticed fabric and can be opened by a zipper 17.

FIG. 2*a* shows an example of the interior fittings 18 of the outside pocket 15, said interior fittings preferably being provided in the form of an inserted panel, which has a plurality of closable small pockets 19 and is connected to the wall 16 formed by the latticed net.

After the front side wall 5 has been folded back, the space of the narrow second section 11 is accessible. The narrow second section 11 is reinforced by a peripheral frame 42 and separated by a partition 20 from the broad first section 10. Preferably arranged in front of the partition are two pockets 21 for shirts, which pockets can be fastened to the partition 20 in the exemplary embodiment illustrated, for example, by touch and close fastener tapes 22. Above the pockets 21 for shirts there is preferably a rolled net 23 for soiled linen or the like. This rolled net can be opened and closed by a zipper 24 extending over its length.

Figure 3:
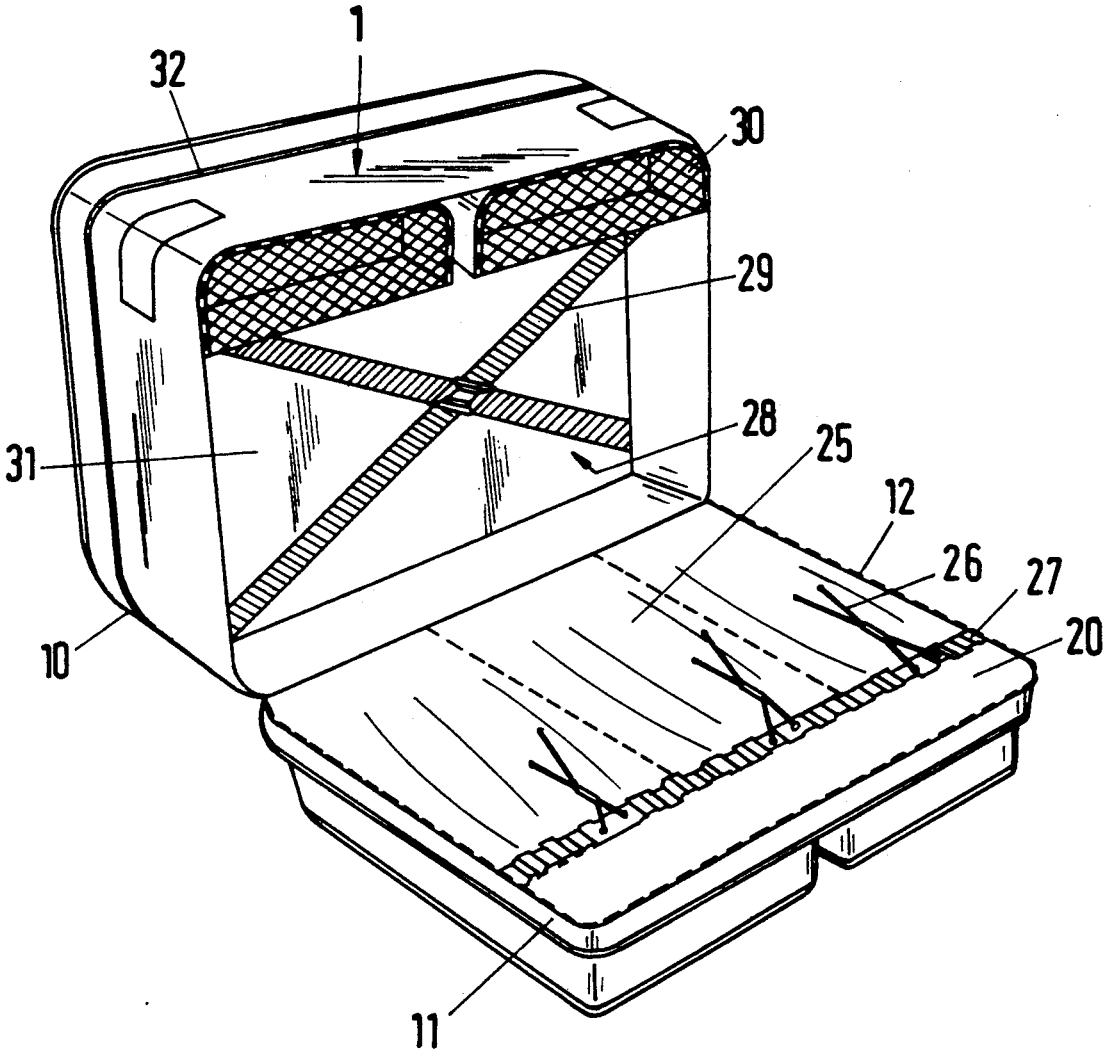
FIG. 3 is a perspective view of the suitcase according to FIG. 1 after the narrow second section has been folded back from the broad first section.

FIG. 3 shows the zipped suitcase after the zipper 12 has been undone and the narrow second section 11 has been folded down. In this position, the rear side of the partition 20 of the narrow second section 11 lies approximately horizontally. This rear side is fitted, for example, with an elasticated pocket 25 which has a top closure edge 27 which can be pulled tight by cords 26.

After the narrow second section 11 has been folded back, a first space 28 of the broad first section 10 is accessible. In the exemplary embodiment illustrated, this space preferably is constructed as customary packing space with two interconnectable packing straps 29. Preferably provided in this space 28 under the top side 1 are two compartments 30 which can be closed by nets and serve to accommodate socks or the like. Since the suitcase preferably is used in such a manner that the broad first section 10 always stands upright, it may be expedient to fill the space 28 with compartments, which can be inserted and closed, to accommodate items of clothing.

Figure 4A:
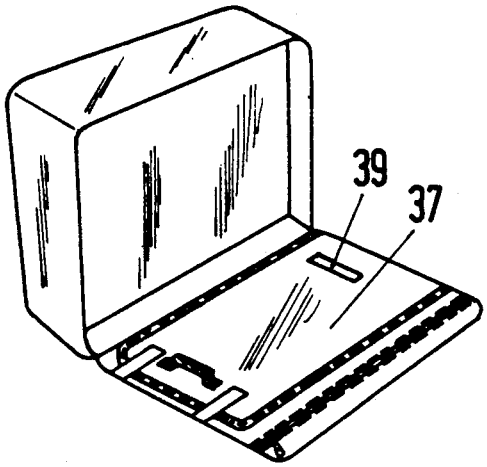
FIG. 4*a* is a perspective view of the suitcase according to FIG. 4 with the packing panel closed.

The space 28 is closed at the rear by a partition 31. Between the partition 31 and the partition 20 of the narrow second section 11, the broad first section is reinforced by a first peripheral frame 43, which is connected via a resilient compression joint 32 positioned at the partition 31 to a second peripheral frame 44 which surrounds the packing space 33 which is illustrated in FIG. 4 and is accessible by folding back the rear large side wall 6. Preferably provided on the top side of this packing space and mounted on the second peripheral frame 44 is a holder 34 for coat-hangers 35. A tensioning strap 36, preferably extends in the lower region in front of the partition 31, and holds the pants and jackets hung on the respective coat-hanger 35 in front of the partition. These clothes can be placed during packing in such a way that they form about a 90° angle with a part of the folded clothes lying on the folded-back rear side wall 6. The rear large side wall 6 has on the side facing the packing space 33 a packing panel 37 which is hinged laterally. To fasten the part of the folded clothes lying on the rear side wall 6, the packing panel 37 can be folded away from the interior of the suitcase and then folded back in and fastened by touch and close fastener tapes 38 in front of the rear side wall 6 so that the packing panel 37 encompasses the part of the folded clothes lying on the rear side wall 6. FIG. 4*a* shows the suitcase in the state of the folded-in packing panel 37 fastened by the touch and close fastener tapes 38. Said packing panel can be further fitted over its length with an elastic tape 39 to accommodate ties.

In the exemplary embodiment illustrated, the space left free by the shape of the coat-hangers 35 in the top corners of the packing space 33 preferably is filled by triangular pockets 40 closed by latticed nets, said pockets likewise being suitable for accommodating small items of clothing, for example underwear.

The large rear side wall 6 is of double-wall construction so that it presents a pocket for accommodating flat objects, which pocket can be closed by a zipper 41 arranged on the inside of the large side wall 6 over its length.

The zipped suitcase illustrated allows all the items of clothing and utensils required for a journey to be accommodated in an organized manner and it is very stable due to the three-frame structure.

Figure 5:
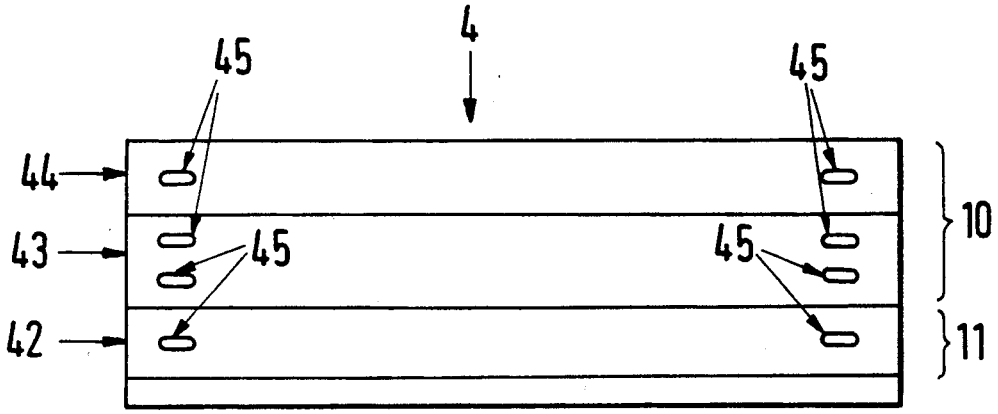
FIGS. 5 and 5*a* are plan views of alternative embodiments of the bottom part of the suitcase according to the present invention.

Since the suitcase is suitable for accommodating the complete travel baggage of one person, it preferably is fitted with wheels 45 on its bottom, by means of which wheels the suitcase can be wheeled when it is gripped by a suitcase handle 2. As shown in FIG. 5, four wheels 45 preferably are arranged adjacent to one another over the width of the suitcase at both ends in longitudinal direction, of which wheels one is attached to the narrow second section 11, two are attached to the first peripheral frame 43 and one is attached to the second peripheral frame 44 of the broad first section 10. Thus the suitcase runs on eight wheels.

Figure 5A:
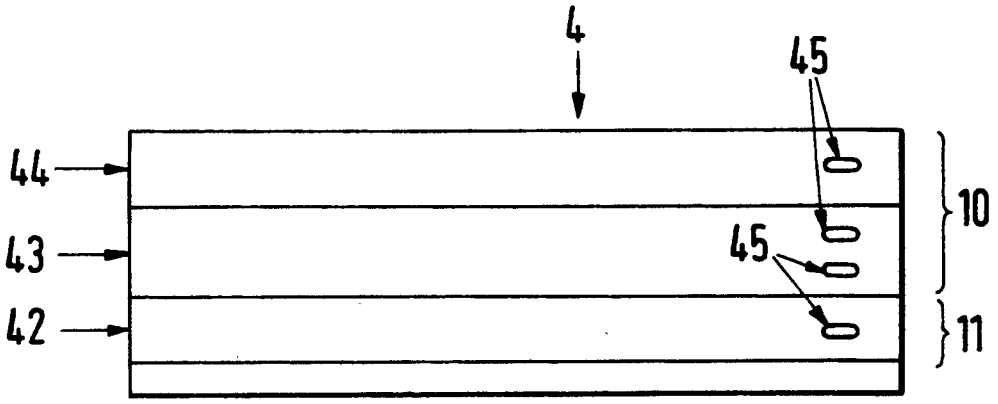
Figure 6:
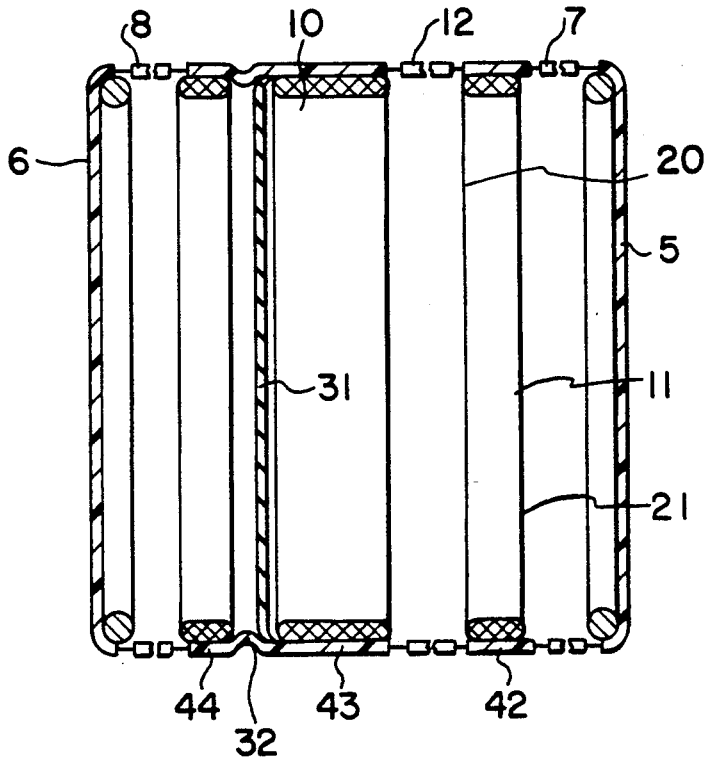
FIG. 6 is a sectional end view of the suitcase illustrated in FIG. 1.

As shown in FIG. 5*a*, it also is possible to fit wheels 45 only on one side and to arrange a handle, for example in the form of a fabric loop, on the opposite narrow side wall 3, by means of which the suitcase can be lifted so that it runs on the four wheels arranged adjacent to one another.

What is claimed is:

1. A zipped suitcase having a top side, two narrow side walls, a bottom part and first and second large side walls which can be folded back from a frame-reinforced body via first and second zippers extending over the length of the two narrow side walls and the top side, wherein the frame-reinforced body comprises a broad first section, reinforced by first and second peripheral frames connected to one another via a compression joint, which broad first section has a partition between the two frames, and a narrow second section connected to the broad first section via a third zipper, which narrow second section is reinforced by a third peripheral frame, said first, second and third peripheral frames extending around the entire periphery of said suitcase.

2. A zipped suitcase as recited in claim 1, wherein the partition divides the broad first section into two separate packing spaces.

3. A zipped suitcase as recited in claim 1, further comprising a first set of four wheels attached to one end of the bottom part of the suitcase and arranged adjacent to one another over the width of the bottom part.

4. A zipped suitcase as recited in claim 3, further comprising a second set of four wheels attached to the other end of the bottom part of the suitcase and arranged adjacent to one another over the width of the bottom part.

5. A zipped suitcase as recited in claim 3, wherein two of the wheels are attached to the first peripheral frame and the other two wheels are attached one on each of the other two peripheral frames.

6. A zipped suitcase as recited in claim 1, further comprising, on one side of the partition, a holder for coat-hangers mounted on the top side of the second peripheral frame.

7. A zipped suitcase as recited in claim 1, further comprising at least one pocket for shirts arranged in the narrow second section, which pocket can be opened after the adjacent first large side wall has been folded back.

8. A zipped suitcase as recited in claim 1, wherein the first large side wall, which can be folded back from the narrow second section, is fitted with at least one outside pocket and a flap for closing the outside pocket.

9. A zipped suitcase as recited in claim 8, wherein the outside pocket further comprises at least one closable small pocket arranged so that the small pocket is accessible after the flap has been opened.

10. A zipped suitcase as recited in claim 1, wherein the second large side wall, which can be folded back from the broad first section, includes a packing panel which can be folded away from the interior of the suitcase.

11. A zipped suitcase as recited in claim 10, wherein the folded-in packing panel is fastened to the second large side wall by closure means.

12. A zipped suitcase as recited in claim 1, wherein the second large side wall, which can be folded back from the broad first section, has a zipped pocket extending over its entire length.

13. A zipped suitcase as recited in claim 1, wherein the frames are comprised of injection-molded plastic.

14. A zipped suitcase as recited in claim 1, wherein all the walls comprise a flexible material.

* * * * *